US005388688A

United States Patent [19]

Kiiski

[11] Patent Number: 5,388,688

[45] Date of Patent: Feb. 14, 1995

[54] PEN-CASE CONVERTIBLE INTO A PEN-STAND

[75] Inventor: Heikki Kiiski, Turku, Finland

[73] Assignee: Oy Leo Longlife Ltd., Finland

[21] Appl. No.: 175,399

[22] PCT Filed: Dec. 18, 1991

[86] PCT No.: PCT/FI91/00398

§ 371 Date: Jan. 19, 1994

§ 102(e) Date: Jan. 19, 1994

[87] PCT Pub. No.: WO93/02588

PCT Pub. Date: Feb. 18, 1993

[30] Foreign Application Priority Data

Jul. 30, 1991 [FI] Finland ..... 913289

[51] Int. Cl.[6] ..... A45C 11/34; B65D 85/28

[52] U.S. Cl. ..... 206/214; 211/69.5

[58] Field of Search ..... 206/214; 211/69.5

[56] References Cited

U.S. PATENT DOCUMENTS

| | | | |
|---|---|---|---|
| 1,719,840 | 7/1929 | Horix | 206/214 |
| 1,777,741 | 10/1930 | Benson . | |
| 3,409,122 | 11/1968 | Hayes et al. . | |
| 4,195,650 | 4/1980 | Ullmann et al. . | |
| 4,260,057 | 4/1981 | Wall-Andersen . | |
| 4,669,617 | 6/1987 | Boeckmann et al. . | |

FOREIGN PATENT DOCUMENTS

| | | | |
|---|---|---|---|
| 465991 | 2/1914 | France | 206/214 |
| 1501989 | 10/1967 | France | 206/214 |
| 2522942 | 9/1983 | France | 206/214 |
| 60943 | 3/1968 | Germany | 206/214 |
| 2154431 | 5/1973 | Germany . | |
| 2358900 | 6/1975 | Germany | 206/214 |
| 2538030 | 3/1977 | Germany | 206/214 |
| 2537730B2 | 6/1978 | Germany . | |
| 3727877C2 | 9/1989 | Germany . | |

*Primary Examiner*—William I. Price

*Attorney, Agent, or Firm*—Finnegan, Henderson, Farabow, Garrett & Dunner

[57] ABSTRACT

A pen-case having a bottom plate with attachments for securing a pen or pencil thereto. In the central region of the bottom plate is a pivot area at which the bottom plate can be folded double, the attachments being located on both ends of the bottom plate and at least one receptacle being provided where the pen or pencil, detached from said attachments, can be carried and supported in a substantially vertical position when the folded bottom plate is in a substantially horizontal position.

10 Claims, 1 Drawing Sheet

PEN-CASE CONVERTIBLE INTO A PEN-STAND

BACKGROUND OF THE INVENTION

The present invention concerns a pen-case.

Various pens of better quality, such as e.g. ball-point pens, ink-pens, refillable pencils and equivalent, are nowadays mostly held on sale in cases containing one or two pens/pencils, and these cases are usually thrown away after the pen has been bought. In use, the pen/-pencil is then often kept, on desks and equivalent, in separately purchased pen stands.

The present usage, described above, causes, to the user of the pen, extra costs arising from the purchase of a pen stand, as well as refuse disposal costs from the discarding of the original pen-case. Moreover, in the existing state of art frequently no suitable pen stand is immediately available, and therefore new pens or pencils tend to lie around on tables in indeterminate manner.

The object of the invention is to eliminate the drawbacks mentioned in the foregoing. It is a particular aim of the invention, to provide a novel pen-case which can also be used as a pen stand on the table.

SUMMARY OF THE INVENTION

The pen-case of the invention comprises a bottom shaped like a plate and having attachments for attaching the pen thereto. As taught by the invention, in the central region of said bottom is provided a pivot area, a pivot structure or another equivalent folding area at which the bottom can be folded double. Furthermore, the bottom is provided, preferably at one end or the other, with a receptacle in which the pen, which has been detached from said attachments, can be held and supported in substantially vertical position when the plate-like, doubled-up bottom is in substantial horizontal position.

In this way, according to the invention, the pen-case in which the pen was bought can be converted into a less bulky, sturdy entity, into a pen stand, which when it is placed on the table constitutes a firm and convenient stand for the pen.

BRIEF DESCRIPTION OF THE DRAWINGS

The various embodiments of the invention, and its other advantages, will be apparent from the claims and from the description following hereinbelow, in which reference is made to the attached drawing, wherein:

DETAILED DESCRIPTION OF THE INVENTION

Figure 1:
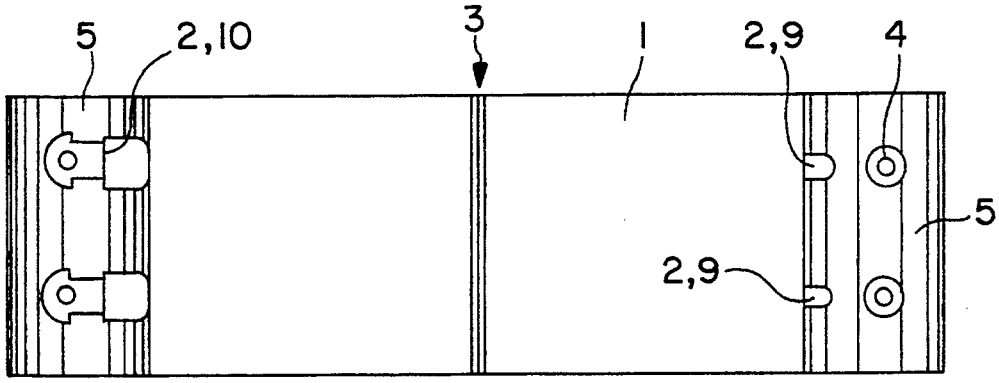
FIG. 1 presents, viewed from above, a pen-case according to the invention.
Figure 2:
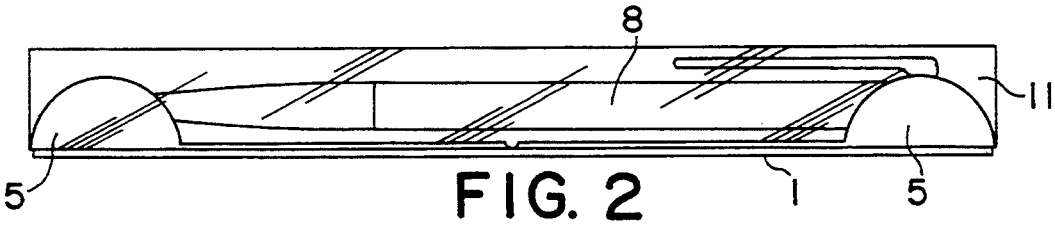
FIG. 2 presents the pen-case with lid and pen(s) in elevational view.
Figure 3:
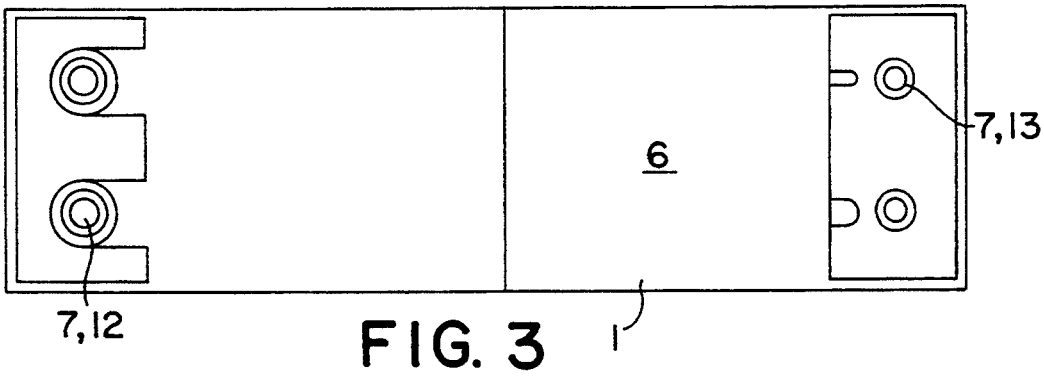
FIG. 3 presents the same pen-case, viewed from below.

As shown in FIGS. 1-3, a pen-case conforming to the invention comprises an elongated and plate-like bottom 1 with substantially rectangular shape and on the ends of this bottom, attachments 2 in which the pen (or pencil) 8 can be secured. The pen-case depicted in the drawing is a two-pen/pencil package, thus also making a stand for two pens/pencils.

In the centre of the elongated bottom 1, dividing the bottom into two equally large parts, is located a pivot area 3 consisting of a groove, or weakened line, in the top surface of the bottom, whereby the bottom can be folded double along said groove, the undersides of the bottom against each other.

On both ends of the bottom belong expanded portions 5 with semicircular cross section and extending over the width of the bottom, in which the attachments 2 holding the pen/pencil consist, at one end, of small grooves or depressions 9 in which the point of the pen/pencil can be placed, and in the other expanded portion of corresponding slots 10 in which the top end of the pen/-pencil, e.g. the press button of a ballpoint pen, can be secured. Hereby the pen/pencil which has been fixed in the pen-case will serve to stiffen the bottom, so that the bottom itself with its pivot area may be a comparatively resilient structure, and which can be folded double with ease.

That expanded portion 5 which carries the notches or depressions 9 lending support to the point of the pen comprises furthermore receptacles 4, in the present case round, conical holes tapering downward towards the bottom I, their shape substantially conforming to the shape of the particular pen/pencil which is sold in this particular pen-case, so that the pen/pencil can be inserted in the receptacle in upright position.

As shown in FIG. 2, it is further possible to use on the pen-case a cover 11, which adds to the rigidity of the pen-case, and protects the pens. Its use is not indispensable however: the pens alone make the bottom rigid enough to provide for the pens a sturdy case.

As shown in FIG. 3, locking members 7 belong on the underside of the bottom of the pen-case, in the regions of either end, these being in the present case circular recesses 12 and counter-pins 13 of a corresponding shape.

Figure 4:
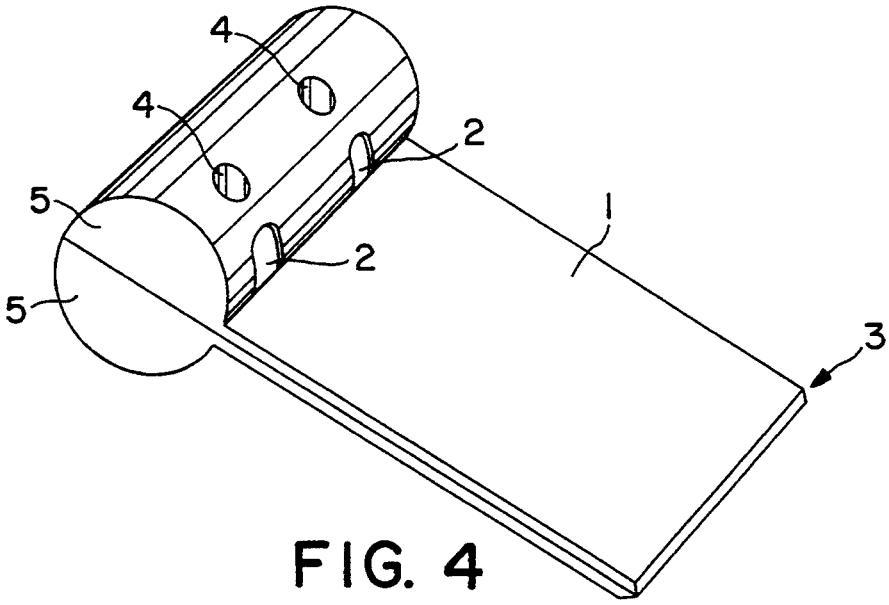
FIG. 4 presents the pen-case after it has been converted into a pen stand.

When the pen-case is folded double at the pivot area 3 as seen in FIG. 4, bringing the undersides of the bottom against each other, the expanded portions 5 on the ends of the bottom join to form at one end of the pen stand a cylindrical expanded portion, inside which the recesses 12 and counter-pins 13 meet each other and interlock the expanded portions. Therefore, as shown in FIG. 4, the pen stand can be placed on a table or desk so that the holes 4 in the expanded portion 5 open upward, whereby they are able to receive the pen/pencil that was bought in this case, in upright position to be kept on the table.

It should be noted that the pen-case and pen stand of the invention may be provided with attachments, and with corresponding receptacles, for one, two or several pens/pencils, in any desired number.

In the foregoing the invention has been described by way of example with the aid of the attached drawing, while various embodiments of the invention are feasible within the scope of the inventive idea delimited by the claims.

I claim:

1. A pen-case comprising a bottom plate having attachments at either end for securing a pen or a pencil thereto in parallel with said bottom plate, the central region of the bottom plate having a pivot area at which the bottom plate can be folded double and at least one receptacle where the pen or pencil, detached from said attachments, can be carried and supported in a substantially vertical position while the folded bottom plate is in a substantially horizontal position.

2. The pen-case of claim 1, wherein the pivot area consists of a groove, or a weakened portion, extending across the width of the middle of the bottom plate.

3. The pen-case of claim 2, wherein the attachments are located in expanded portions on either end of the bottom plate and the receptacle is located in one of said expanded portions.

4. The pen-case of claim 3, wherein the expanded portions are eminences rising from the plane of the bottom plate and extending across the width of the bottom plate.

5. The pen-case of claim 4, wherein the underside of the bottom plate is substantially straight and at the location of the expanded portions are locking members that interlock with each other when the two halves of the bottom plate have been folded against each other.

6. The pen-case of claim 5, wherein the attachments and the pen or pencil to be attached thereto correspond with each other in shape so that the pen or pencil held in said attachments will lock the halves of the foldable bottom plate to form a flat, rigid plate.

7. The pen-case of claim 1 including a cover for covering the top side of the bottom plate and the attachments.

8. The pen-case of claim 3, wherein said receptacle comprises a depression in one of said expanded portions conforming to the shape of the point of a pen or pencil.

9. The pen-case of claim 3, wherein the expanded portions of the bottom plate of the pen-case have at least two sets of attachments for holding a corresponding number of pens or pencils and a corresponding number of receptacles for the respective pens or pencils.

10. The pen-case of claim 5, wherein when the halves of the bottom plate are folded against each other and locked together by said locking members, the expanded portions together form a substantially cylindrical body from which the halves of the bottom plate, lying against each other, extend substantially radially in one and the same direction.

* * * * *